US008528650B1

(12) United States Patent
Smith et al.

(10) Patent No.: US 8,528,650 B1
(45) Date of Patent: Sep. 10, 2013

(54) MANDREL CASING HANGER AND RUNNING TOOL SYSTEM

(75) Inventors: Jerry D. Smith, Spring, TX (US); Martin Anthony Trumbull, Cypress, TX (US)

(73) Assignee: GE Oil & Gas Pressure Control LP, Houston, TX (US)

( * ) Notice: Subject to any disclaimer, the term of this patent is extended or adjusted under 35 U.S.C. 154(b) by 386 days.

(21) Appl. No.: 13/034,534

(22) Filed: Feb. 24, 2011

(51) Int. Cl.
*E21B 23/00* (2006.01)

(52) U.S. Cl.
USPC ..... 166/382; 166/208

(58) Field of Classification Search
USPC ..... 166/382, 208
See application file for complete search history.

(56) References Cited

U.S. PATENT DOCUMENTS 4,953,617 A * 9/1990 Ross et al. ..... 166/187
6,065,536 A * 5/2000 Gudmestad et al. ..... 166/208
2010/0326674 A1* 12/2010 Nguyen et al. ..... 166/382

* cited by examiner

*Primary Examiner* — Brad Harcourt
(74) *Attorney, Agent, or Firm* — Bracewell & Giuliani LLP

(57) ABSTRACT

A method for rotating a casing string in a borehole and a mandrel casing hanger and running tool system, include a selectively engageable connection between a mandrel casing hanger and a running tool; and a rotational force may be applied to the mandrel casing hanger, running tool, and casing string, without substantially tightening a threaded connection between the running tool and the mandrel casing hanger, by transmitting the rotational force through the selectively engageable connection.

14 Claims, 2 Drawing Sheets

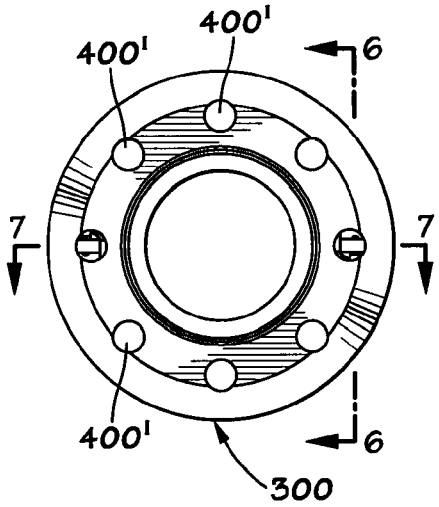
FIG. 5
FIG. 6
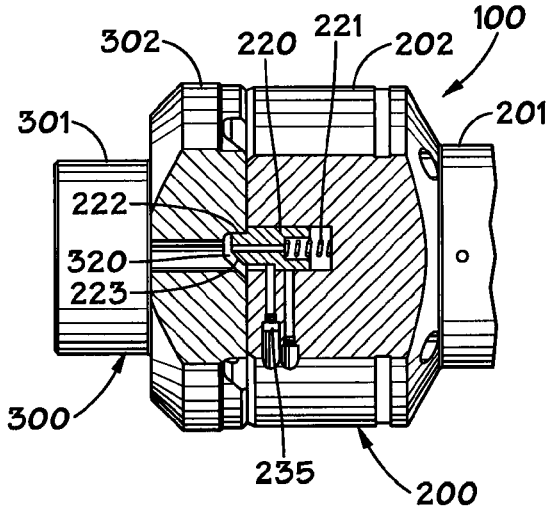
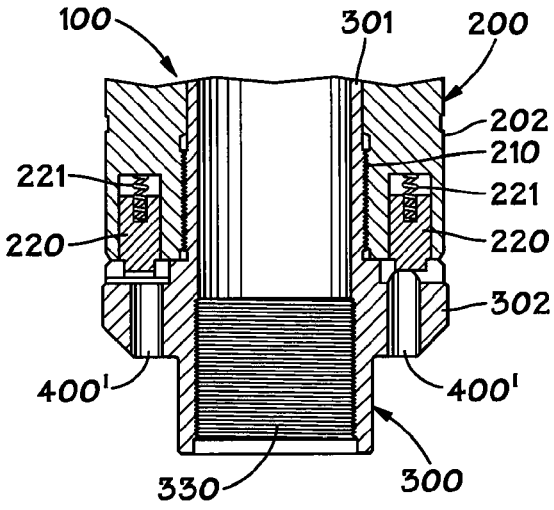
FIG. 7
FIG. 8
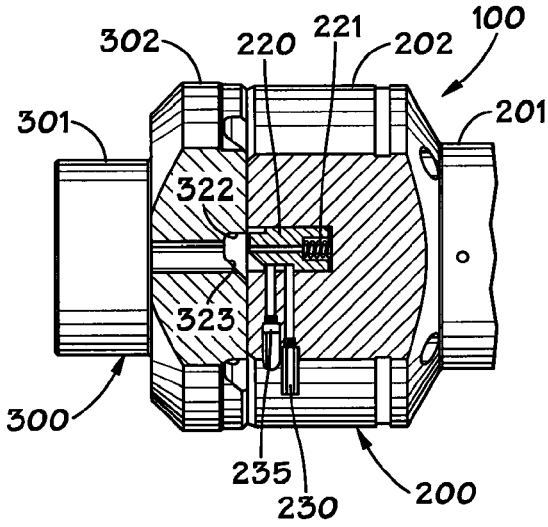

MANDREL CASING HANGER AND RUNNING TOOL SYSTEM

RELATED APPLICATION

This Application claims the benefit, and priority benefit, of U.S. Patent Application Ser. No. 61/307,736, filed Feb. 24, 2010, entitled "Mandrel Casing Hanger and Running Tool System".

BACKGROUND OF THE INVENTION

1. Field of the Invention

The invention relates to a mandrel casing hanger and running tool system for use with a casing string in casing operations in a borehole of a well for producing hydrocarbons.

2. Description of the Related Art

Various mandrel casing hangers and running tools have been previously used in casing operations. When a casing string is run into a well, or borehole, the casing string movement is generally limited to only vertical reciprocation movement. Rotation of the casing string to the right is limited due to concerns about applying too much torque to the connections in the casing string. Rotation of the casing string to the left is limited due to concerns about over backing off, or unthreading, connections in the casing string.

SUMMARY OF THE INVENTION

In accordance with the illustrative embodiments hereinafter described, the present mandrel casing hanger and running tool system may include: a mandrel casing hanger, a running tool therefor, and a selectively engageable connection between the mandrel casing hanger and the running tool, whereby the mandrel casing hanger and running tool may be rotated in a clockwise direction, or to the right, without any substantial tightening of a threaded connection between the mandrel casing hanger and the running tool.

BRIEF DESCRIPTION OF THE DRAWING

The present mandrel casing hanger and running tool system may be understood by reference to the following description taken in conjunction with the accompanying drawing, in which:

FIG. 5 is a bottom view of the system of FIG. 1, with two retaining screws removed;

FIG. 6 is a partial cross-sectional view of an embodiment of the present system of FIG. 1, taken along line 6-6 of FIG. 5, with two retaining screws removed;

FIG. 7 is a partial cross-sectional view of the present system of FIG. 1, taken along line 7-7 of FIG. 5; and FIG. 8 is a partial cross-sectional view of the present system of FIG. 1, similar to FIG. 6, which includes a retaining screw.

Figure 1:
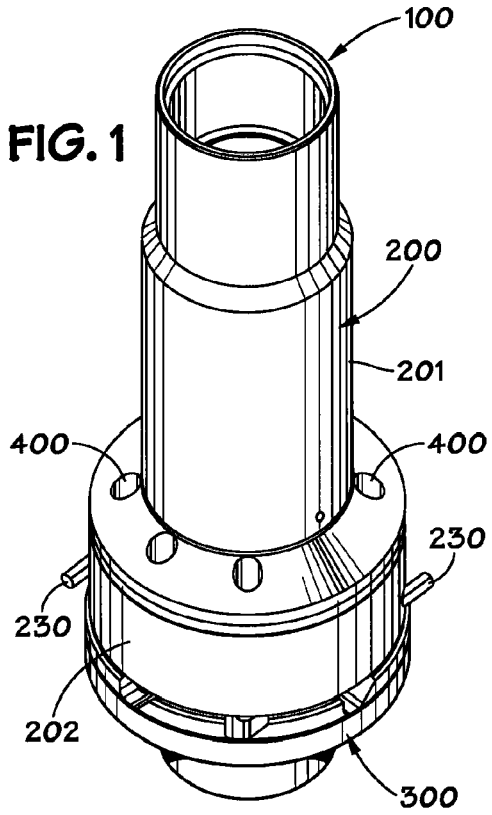
FIG. 1 is a perspective view of an illustrative embodiment of the present system.

While certain embodiments of the present mandrel casing hanger and running tool system will be described in connection with the preferred illustrative embodiments shown herein, it will be understood that it is not intended to limit the invention to those embodiments. On the contrary, it is intended to cover all alternatives, modifications, and equivalents, as may be included within the spirit and scope of the invention as defined by the appended claims. In the drawing figures, which are not to scale, the same reference numerals are used throughout the description and in the drawing figures for components and elements having the same structure, and primed reference numerals are used for components and elements having a similar function and construction to those components and elements having the same unprimed reference numerals.

DETAILED DESCRIPTION OF THE SPECIFIC EMBODIMENTS

With reference to FIGS. 1-8, an illustrative embodiment of a mandrel casing hanger and running tool system 100 is illustrated, which is intended for use in casing operations in a borehole, or well, for the production of hydrocarbons, and generally includes a running tool 200 and a mandrel casing hanger 300. The running tool 200 includes an internal, right-handed set of threads 210 (FIG. 3), which are threadedly engageable with a mating external right-handed set of threads 310 (FIG. 2) on, or associated with, the mandrel casing hanger, or casing hanger, 300. Mandrel casing hanger preferably includes a set of internal threads 330 (FIG. 7) adjacent its lower end for receiving the externally threaded end, or male threaded end, of a length of conventional casing (not shown), which is part of a casing string, or string of casing, suspended from the casing hanger 300. The running tool 200 is releaseably attached, or threadeadly connected, to the casing hanger 300 by the threaded engagement of threads 210 and 310 (FIGS. 2 and 3), upon casing hanger 300 being received within running tool 200, and relative rotational movement being provided between casing hanger 300 and running tool 200.

Figure 2:
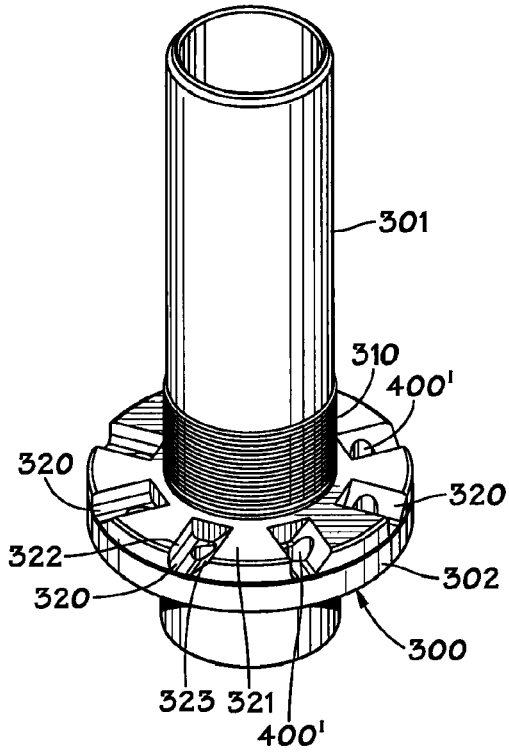
FIG. 2 is a perspective view of an embodiment of the casing mandrel casing hanger of the present system of FIG. 1.

Running tool generally includes a generally cylindrical shaped body member 201 having an annular shaped housing 202 disposed at the lower end of body member 201, as seen in FIGS. 1, 3, and 6-8. Casing hanger 300 generally includes a generally cylindrical shaped body member 301 having an annular shaped flange member, or flange, 302 disposed adjacent the lower end of the body member 301, as shown in FIG. 2. As shown in FIGS. 1 and 7, body member 201 of running tool 200 generally receives body member 301 of casing hanger 300, with flange 302 of casing hanger 300 abutting the lower end of annular housing 202 of running tool 200.

At least four, and preferably a plurality of, milled slots, or slots, 320 are formed in the flange face 321 of flange 302 of the casing hanger 300 (FIG. 2). The plurality of slots are radially spaced about flange 302, and preferably are equidistantly spaced from each other. For illustrative purposes, eight slots 302 are shown, although a larger or smaller number may be used. Each of the milled slots 320 includes a vertically extending wall surface 322 and an angled, or beveled, wall surface 323, as shown in FIGS. 2 and 8. Wall surfaces 322 are generally disposed in a coplanar relationship with the longitudinal axis of the system 100, and wall surfaces 323 are generally disposed in an angular, non-coplanar disposition with respect to the longitudinal axis of system 100. The running tool 200 has at least one, and preferably at least two, retractable, spring loaded, or spring biased, dog members, or dogs, 220 (FIGS. 3 and 6-8) with associated springs 221 (FIGS. 6-8) disposed within housing 202. If desired, a greater number of dogs 220 may be used. The dogs 220 are initially fixed within running tool 200 in their retracted configuration, with the springs 221 compressed, by use of retaining screws 230, as shown in FIGS. 2, 4 and 8. Upon the removal of the retaining screws 230, the springs 221 expand and the dogs 220 move downwardly and outwardly of housing 202 into their expanded, slot-engaging configuration shown in FIGS. 6 and 7, with dogs 220 engaging slots 320 of casing hanger 300. A guide pin 235 (FIGS. 6 and 8) may be used to align and guide the movement of each of the dogs 220.

Figure 3:
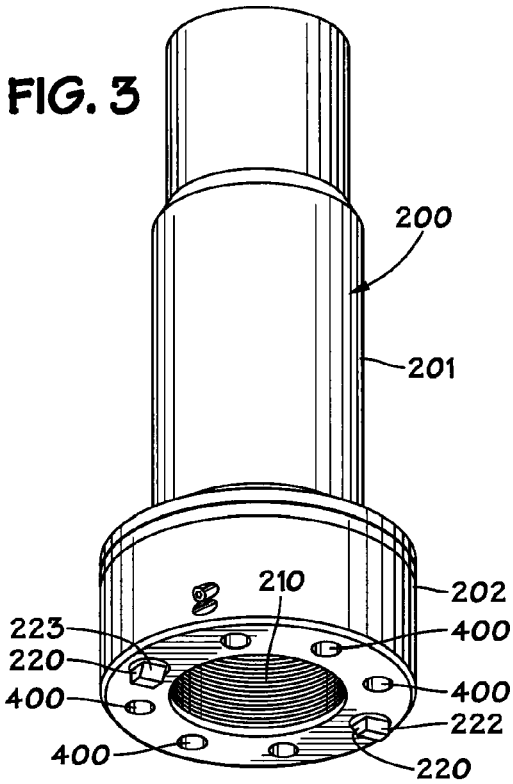
FIG. 3 is a perspective view of an embodiment of the running tool of the present system of FIG. 1.
Figure 4:
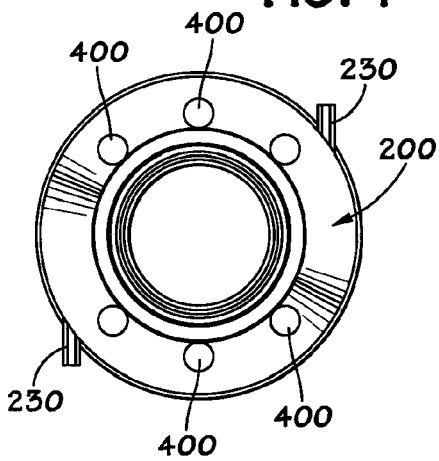
FIG. 4 is a top view of the system of FIG. 1.

As shown in FIGS. 3 and 6, each of the dogs 220 has a vertically extending wall surface 222 which may be disposed adjacent, or abut, wall surface 322 of slots 320 in casing hanger 300, when dogs 220 are in their expanded, slot-engaging configuration of FIGS. 6 and 7. Each of the dogs 220 also have an angled, or beveled wall surface 223 which may be disposed adjacent to, and generally conforms to the shape of, the angled, or beveled wall surface 323 of the slots 320 in casing hanger 300. Wall surfaces 222 are generally disposed in a coplanar relationship with the longitudinal axis of the system 100 and the wall surfaces 223 are generally disposed in an angular, non-coplanar disposition with respect to the longitudinal axis of system 100. The running tool 200 and casing hanger may be provided with a plurality of mating fluid bypass passageways 400, 400' (FIGS. 2-4).

As will be hereinafter described in greater detail, the running tool 200 may be attached to the casing hanger 300 with the right handed sets of threads 210, 310. Any torque generated from rotating the casing string (not shown) while running the casing hanger 300 is transmitted through the retractable, spring loaded dogs 220 in the bottom of the running tool 200 to the vertical extending wall surface 322 of the milled slots 320 in the flange face 321 of the casing hanger 300.

To attach the running tool 200 to the casing hanger 300, the dogs 220 are initially retracted up into the bottom of the running tool 200 and held in place with the retaining screws 230. The running tool 200 is then screwed onto the casing hanger 300 using the right hand Acme running threads 210, 310 until the running tool 200 and casing hanger 300 are brought to a positive stop. The dog retaining screws 230 are then removed and the running tool is turned to the left, or counter-clockwise when viewed from the top of system 100, until the dogs 220 spring downwardly into, or in engagement with, the milled slots 320 in the flange face 321 of the casing hanger 300.

The mandrel casing hanger and running tool system 100 is then made up into the casing string (not shown), as by threading an end of the casing string into the set of threads 330 of casing hanger 300 The system 100 and casing string is then run through the stack (not shown) to land the casing hanger 300 on the load shoulder in the casing head (not shown) in a conventional manner. If the casing string is rotated to the right, or clockwise when viewed from the top of system 100, while running the mandrel casing hanger 300, the vertical wall surfaces 222 of the running tool dogs 220 engage with the milled slots 320 of the hanger 300, as by abutting the vertical wall surfaces 322 of slots 320, and transmit the torque directly from the dogs 220 to the milled slots 320, therefore substantially bypassing the running tool threaded connection between threads 210 of running tool 200 and threads 310 of hanger 300. Once the casing hanger 300 is landed, the running tool 200 may be rotated to the left, or counter-clockwise when viewed from the top of system 100, thus unscrewing the running tool 200 from the casing hanger 300. The beveled wall surfaces 223 of the retractable dogs 220 slide upwardly and over the beveled wall surfaces 323 of the milled slots 320 in the hanger flange 302, so that as the running tool 200 rotates to the left, or counter-clockwise, the dogs 220 will initially enter the slots 320 and then will retract from the slots 320 back into the housing 202 of the running tool 200.

Thus, if it is desired to rotate the casing string, as for example, in highly deviated boreholes, resulting from horizontally directional drilling operations, it is possible to rotate the casing string in a clockwise, or right handed direction, when viewed from the upper end of the casing string, or system 100, in order to get the casing fully installed in the well. This right hand rotation may be obtained without applying an excessive amount of torque to, and without any substantial tightening of, the threaded connection of the sets of threads 210, 310 between the running tool 200 and the casing hanger 300, whereby the running tool 200 and casing hanger 300 may be easily disassembled, or disengaged, from one another after the casing string and casing hanger 300 have been landed in the casing head.

Specific embodiments of the present mandrel casing hanger and running tool system have been described and illustrated. It will be understood to those skilled in the art that changes and modifications may be made without departing from the spirit and scope of the inventions defined by the appended claims.

We claim:

1. A mandrel casing hanger and running tool system, comprising:

a mandrel casing hanger having an upper and a lower end, an annular shaped flange and a set of internal threads disposed adjacent the lower end of the mandrel casing hanger, the set of internal threads adapted to receive a threaded end of a length of casing, and a set of external threads disposed on the mandrel casing hanger and above the flange;

a running tool having an upper and a lower end, including an annular shaped housing disposed at the lower end of the running tool, a set of internal threads disposed within the lower end of the running tool, the set of internal threads of the running tool being releaseably engaged with the external set of threads of the mandrel casing hanger when the mandrel casing hanger is received within the running tool, to provide a threaded connection between the running tool and the mandrel casing hanger; and a selectively engageable connection between the mandrel casing hanger and the running tool, whereby upon rotation of the mandrel casing hanger and running tool in a first direction, the length of casing may be rotated without any substantial tightening of the threaded connection between the running tool and the mandrel casing hanger, and upon rotation of the running tool in a second direction, the threaded connection between the running tool and the mandrel casing hanger is disengaged.

2. The mandrel casing hanger and running tool system of claim 1, wherein the selectively engageable connection is associated with the housing of the running tool and the flange of the mandrel casing hanger.

3. The mandrel casing hanger and running tool system of claim 2, wherein the selectively engageable connection includes at least one dog member disposed within the housing of the running tool, and at least four slots associated with the flange of the mandrel casing hanger, and the at least one dog member is engageable with one of the at least four slots.

4. The mandrel casing hanger and running tool system of claim 3, wherein at least two dog members are disposed within the housing of the running tool, and the at least two dog members are spring biased to extend outwardly of the housing of the running tool into engagement with at least two of the slots which are formed in the flange of the mandrel casing hanger.

5. The mandrel casing hanger and running tool system of claim 3, wherein the at least one dog member has a vertically extending wall surface and a beveled wall surface, each of the at least four slots has a vertically extending wall surface and a beveled wall surface, and when the at least one dog member is disposed within one of the at least four slots, the vertically extending wall surface of the at least one dog member is disposed adjacent the vertically extending wall surface of the slot, and the beveled wall surface of the at least one dog member is disposed adjacent the beveled wall surface of the slot.

6. The mandrel casing hanger and running tool system of claim 3, wherein at least one retaining screw is associated with the housing of the running tool for the at least one dog member, and the retaining screw releaseably retains the at least one dog member within the housing of the running tool.

7. The mandrel casing hanger and running tool system of claim 3, wherein the housing of the running tool and the flange of the mandrel casing hanger include a plurality of mating fluid bypass passageways.

8. A method for rotating a casing string in a borehole, comprising:

providing a mandrel casing hanger and running tool system, including: a mandrel casing hanger having an upper and a lower end, an annular shaped flange and a set of internal threads disposed adjacent the lower end of the mandrel casing hanger, and a set of external threads disposed on the mandrel casing hanger and above the flange; a running tool having an upper and a lower end including an annular shaped housing disposed at the lower end of the running tool, and a set of internal threads disposed within the lower end of the running tool; and a selectively engageable connection between the mandrel casing hanger and the running tool;

attaching the running tool to the mandrel casing hanger by disposing the mandrel casing hanger within the running tool and providing relative rotational movement between the running tool and the mandrel casing hanger to releaseably engage the set of internal threads of the running tool with the set of external threads of the mandrel casing hanger to provide a threaded connection between the running tool and the mandrel casing head;

engaging the selectively engageable connection between the mandrel casing hanger and the running tool;

attaching the casing string to the mandrel casing hanger and running tool system by disposing an end of the casing string within the set of internal threads of the mandrel casing hanger; and providing a rotational force to the mandrel casing hanger and running tool to rotate the casing string without substantially tightening the threaded connection between the running tool and the mandrel casing hanger by transmitting the rotational force through the selectively engageable connection.

9. The method of claim 8, including associating the selectively engageable connection with the housing of the running tool and the flange of the mandrel casing hanger.

10. The method of claim 9, including providing the selectively engageable connection with at least one dog member and disposing the at least one dog member within the housing of the running tool, and associating at least four slots with the flange of the mandrel casing hanger, and engaging the at least one dog member with one of the at least four slots.

11. The method of claim 10, including providing at least two dog members within the housing of the running tool, and spring biasing the at least two dog members to extend outwardly of the housing of the running tool into engagement with at least two of the slots which are formed in the flange of the mandrel casing hanger.

12. The method of claim 10, including providing the at least one dog member with a vertically extending wall surface and a beveled wall surface, providing each of the at least four slots with a vertically extending wall surface and a beveled wall surface, and when the at least one dog member is disposed within one of the at least four slots, disposing the vertically extending wall surface of the at least one dog member adjacent the vertically extending wall surface of the slot, and disposing the beveled wall surface of the at least one dog member adjacent the beveled wall surface of the slot.

13. The method of claim 10, including providing at least one retaining screw associated with the housing of the running tool for the at least one dog member, and releaseably retaining the at least one dog member within the housing of the running tool with the at least one retaining screw.

14. The method of claim 10, including providing the housing of the running tool and the flange of the mandrel casing hanger with a plurality of mating fluid bypass passageways.

* * * * *